United States Patent [19]

Lege

[11] 3,977,047

[45] Aug. 31, 1976

[54] DRESSMAKER'S ATTACHMENT

[76] Inventor: Sabray J. Lege, 1005 Thomas St., Abbeville, La. 70510

[22] Filed: Dec. 4, 1974

[21] Appl. No.: 529,563

[52] U.S. Cl. ..... 24/73 AS; 24/9; 24/72.5; 112/148

[51] Int. Cl.[2] ..... A44B 21/00; D05B 35/00

[58] Field of Search ..... 24/75, 73 CF, 84 A, 24/73 AS, 137 A, 252, 72.5, 9; 297/385; 112/148

[56] References Cited

UNITED STATES PATENTS

| | | | |
|---|---|---|---|
| 211,479 | 1/1879 | Shelby | 24/9 X |
| 220,692 | 10/1879 | Anderson | 24/75 X |
| 1,551,932 | 9/1925 | Carver | 297/385 X |
| 1,552,996 | 9/1925 | Malouf et al. | 112/148 X |
| 2,320,935 | 6/1943 | Johnstone | 297/385 |
| 3,203,061 | 8/1965 | Thomas | 24/137 A X |

FOREIGN PATENTS OR APPLICATIONS

| | | | |
|---|---|---|---|
| 13,551 | 6/1913 | United Kingdom | 24/72.5 |

*Primary Examiner*—Donald A. Griffin
*Attorney, Agent, or Firm*—Victor J. Evans & Co.

[57] ABSTRACT

A dressmaker's attachment for securing material during certain steps of sewing. The attachment comprises a flexible strap having a plurality of spaced apart apertures extending therethrough with a hook secured to the end of the strap and adapted to engage through a selected one of the apertures to secure the strap to a sewing machine, the leg of the seamstress or any other object desired. The opposite end of the strap is provided with a toothed spring clamp for engaging material to hold the material while an operation such as ripping is performed thereon.

3 Claims, 5 Drawing Figures

DRESSMAKER'S ATTACHMENT

BACKGROUND OF THE INVENTION

FIELD OF THE INVENTION

The present invention relates to a dressmaker's attachment for securing material during a dressmaking operation.

SUMMARY OF THE INVENTION

The present invention includes an elongate strap having a plurality of apertures formed in spaced apart relation therein and including a hook at the end thereof for engaging in the apertures to secure the strap to a support. A spring clamp at the opposite end of the strap is provided with teeth and is adapted to engage material to support such material during a dressmaking operation.

The primary object of the invention is to provide a dressmaker's attachment to serve as a "third hand" to secure material during a dressmaking operation.

Other objects and advantages will become apparent in the following specification when considered in light of the attached drawings.

DESCRIPTION OF THE PREFERRED EMBODIMENT

Figure 1:
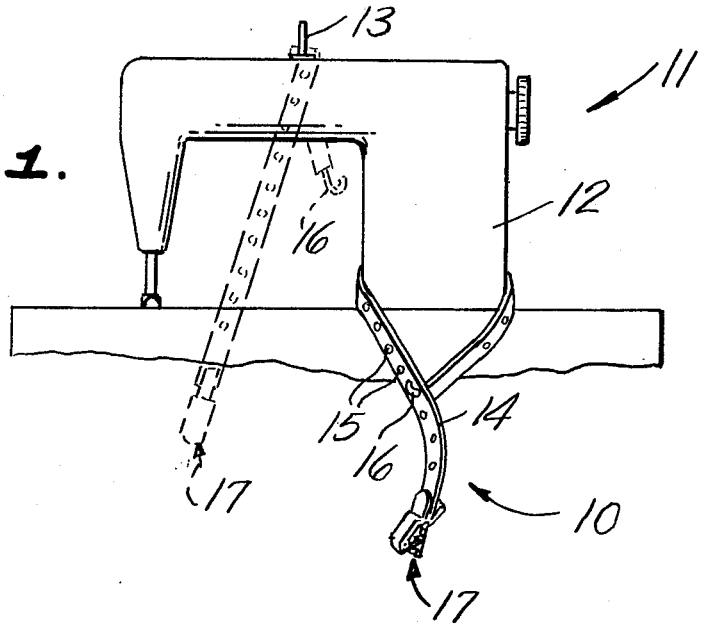
FIG. 1 is a front elevation of the invention shown attached to a sewing machine and in broken lines showing a second mode of attachment to the sewing machine.

Referring now to the drawings in detail wherein like reference characters indicate like parts throughout the several figures the reference numeral 10 indicates generally a third hand dressmaker's attachment constructed in accordance with the invention.

The attachment 10 can be used with a sewing machine generally indicated at 11 including a head 12 and a thread spindle 13.

The attachment 10 includes an elongate flexible strap 14 having a plurality of apertures 15 arranged in spaced apart relation therealong.

A metal hook 16 is joined to one end of the strap 14 and extends longitudinally therefrom. The hook 16 is adapted to extend through any one of the apertures 15 to form a loop which can encompass the head 12 of the sewing machine 11 or may be used to support the strap 14 from any other desired support such as the leg of the dressmaker. In addition a selected one of the apertures

15 could be engaged over the spool spindle 13 as is shown in broken lines in FIG. 1 to support the attachment 10 from another point of the sewing machine 11.

Figure 2:
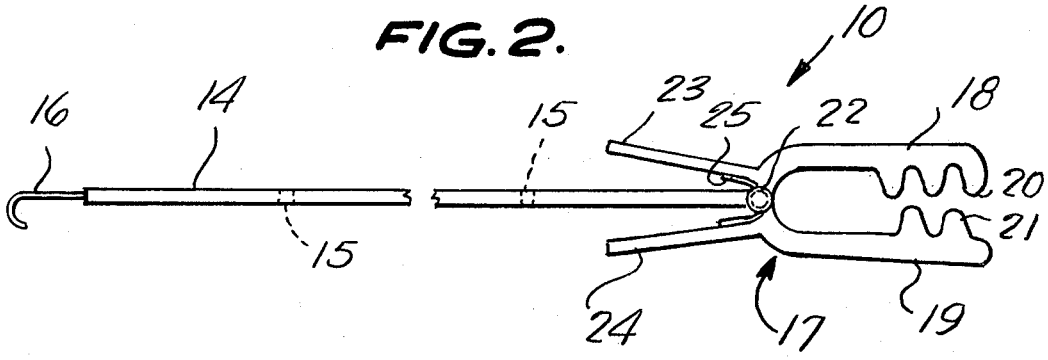
FIG. 2 is a side elevation of the invention.
Figure 3:
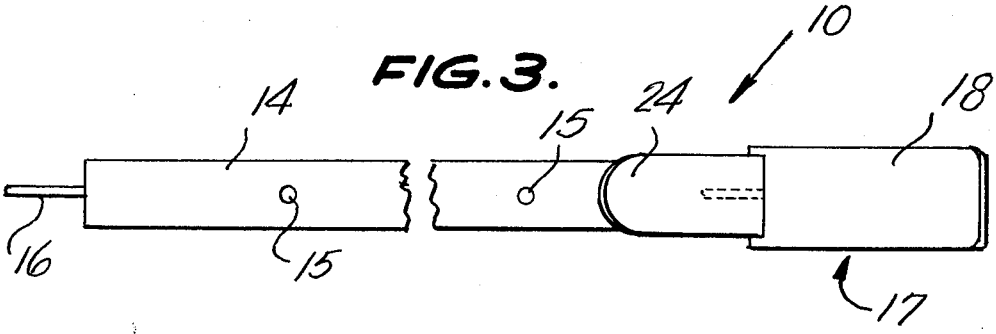
FIG. 3 is a top plan view of the invention.
Figure 4:
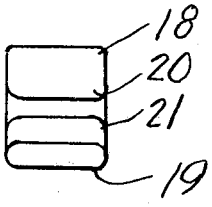
FIG. 4 is an end elevation of the invention.
Figure 5:
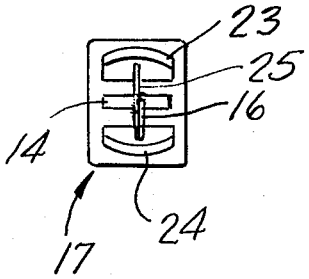
FIG. 5 is an elevation from the opposite end of the invention.

A spring clamp generally indicated at 17 is secured to the end of the strap 14 opposite the hook 16. The spring clamp 17 has a pair of jaws 18, 19 with the jaw 18 having a plurality of teeth 20 and the jaw 19 having a plurality of teeth 21 adapted to interengage with the teeth 20 when the jaws 18 and 19 are brought together. The jaw 18 and the jaw 19 are pivotally secured together by a pintle 22 as can be seen in FIG. 2. An arm 23 extends integrally outwardly from the jaw 18 beyond the pintle 22. An arm 24 extends integrally outwardly from the jaw 19 beyond the pintle 22 and opposed to the arm 23.

A coil spring 25 encompasses the pintle 22 and engages against the arms 23, 24 to normally urge the arms 23, 24 apart to bring the teeth 20, 21 into clamping engagement with material extending therebetween.

In the use and operation of the attachment 10 one panel of a piece of material to be ripped can be secured in the clamp 17 while the other panel can be gripped with the hand. A thread cutter may then be used to cut the thread of the seam securing the panels together quickly and accurately. The attachment 10 may also be used for any other dressmaking operation in which a "third hand" is necessary to secure the material being used.

Having thus described the preferred embodiment of the invention it should be understood that numerous structural modifications and adaptations may be resorted to without departing from the spirit of the invention.

What is claimed is:

1. A dressmaker's attachment comprising an elongate flexible strap having a single row of spaced apart apertures formed therein, a single hook formed from a single piece of metal bent into a half circle secured to one end of said strap and extending longitudinally beyond the center of the end thereof, and a resilient clamp secured to the center of the opposite end of said strap for releasably clamping material therein, said hook being adapted to engage in a selected one of said apertures to form a support encompassing loop.

2. A device as claimed in claim 1 wherein said resilient clamp is provided with hand actuated means for opening said clamp.

3. A device as claimed in claim 1 wherein said resilient clamp includes a pair of separate independent jaws, a pintle for pivotally securing together said jaws, a coil spring encompassing said pintle for urging the jaws together, interengaging teeth formed on the adjacent portions of said jaws, and hand actuated extensions on the jaws on the opposite side of the pintle from the teeth for opening said jaws against the action of the coil spring.

* * * * *

UNITED STATES PATENT AND TRADEMARK OFFICE

CERTIFICATE OF CORRECTION

PATENT NO. : 3,977,047

DATED : August 31, 1976

INVENTOR(S) : Sabray J. Lege

It is certified that error appears in the above-identified patent and that said Letters Patent are hereby corrected as shown below:

The inventor's name is incorrect as printed on the patent. It should be as follows:

Rosella B. Lege

Signed and Sealed this

Twenty-third Day of November 1976

[SEAL]

*Attest:*

RUTH C. MASON
*Attesting Officer*

C. MARSHALL DANN
*Commissioner of Patents and Trademarks*